United States Patent [19]

Onal

[11] 3,935,833

[45] Feb. 3, 1976

[54] JET BOAT PUMP

[75] Inventor: Hasan F. Onal, Denver, Colo.

[73] Assignee: Sundstrand Corporation, Rockford, Ill.

[22] Filed: Aug. 1, 1974

[21] Appl. No.: 493,715

Related U.S. Application Data

[63] Continuation-in-part of Ser. No. 382,374, July 25, 1973.

[52] U.S. Cl. ..... 115/12 R; 60/221; 415/204

[51] Int. Cl.[2] ..... B63H 11/00

[58] Field of Search ..... 115/11, 12 R, 12 A, 14–16; 114/151; 60/221, 222; 415/120, 121, 203, 219, 98

[56] References Cited

UNITED STATES PATENTS

| | | | |
|---|---|---|---|
| 3,082,732 | 3/1963 | Stallman | 115/16 |
| 3,757,728 | 9/1973 | Rhoda | 115/16 |
| 3,805,731 | 4/1974 | Furst et al. | 115/16 |
| 3,809,005 | 5/1974 | Rodler, Jr. | 115/12 R |

*Primary Examiner*—Trygve M. Blix
*Assistant Examiner*—Jesus D. Sotelo
*Attorney, Agent, or Firm*—Wegner, Stellman, McCord, Wiles & Wood

[57] ABSTRACT

A centrifugal pump for a boat which is used to propel the boat by a jet of water created by the pump. The pump includes a housing which is mounted exterior to the hull. A drive shaft and an impeller are mounted to rotate within the housing. The drive shaft extends through the hull of the boat and may be coupled directly to a gas turbine engine or other power generating device. The impeller is of the double suction type and includes ports for equalizing pressures on either side of the impeller at the suction positions thereof. The housing provides a double volute to receive the effluent from the impeller and direct it aft to a nozzle. Nozzle mechanisms are disclosed which provide easy steering and boat trim control under high thrust loads. A thrust reversal system is employed which directs the jet of water forward for stopping and reversing. A new scoop design is also included which reduces drag and yet provides proper flow to the pump.

6 Claims, 6 Drawing Figures

JET BOAT PUMP

This is a continuation-in-part of application Ser. No. 382,374, filed July 25, 1973.

This invention is directed to a jet boat pump. More specifically, this invention is directed to an efficient and compact jet boat pump which is mounted to the transom of the boat and incorporates a low drag inlet scoop.

Jet boats have been commercially available for several years. These boats employ high output pumps which suck water from beneath the boat and exhaust it aft through a nozzle. A major problem which has heretofore plagued these power systems is the amount of power consumed by the pump and not transmitted into motive force. This is due to the lack of suction pressure required for efficient operation of such pumps. These conventional pumps are axial mixed flow pumps which require around a 30° suction entrance approach. As a result of this shallow entrance angle these conventional pumps are not adaptable to be mounted on the boat transoms. Inboard placement of these pumps requires that the intakes be placed through the hull. Consequently, special boat designs have been necessary which have made any subsequent change in power systems impractical. Further, less cockpit space is available on these conventional systems because of the inboard placement of these pumps. The pumps now employed in boat propulsion often experience difficulty with self-priming. Further, these pumps rely on the ram pressure created by the relative movement of the boat through the water for necessary suction head. These characteristics of conventional boat pumps have required substantial scoop structures extending beneath the boat. These structures create significant amounts of drag.

The present device incorporates a novel high speed, high capacity impeller having vanes which each present a low lead angle at the leading edge of the vane near the impeller shroud. This lead angle varies continously across the leading edge of the vane to a substantially larger lead angle at the impeller hub. Further, the impeller and pump case provide a double suction, double volute system which operates to balance the hydraulic and dynamic forces within the pump. As a result of these features, the present pump is substantially more efficient than the pumps previously employed for propelling jet boats. The dynamic and hydraulic balancing of the impeller also reduces the need for high capacity bearing mechanisms for support of the impeller and shaft. Further, the impeller reduces the required suction head and allows a greater angle of attack on the suction entrance. Conventional pumps require this shallow entrance angle for development of dynamic pressure due to the motion of the boat through the water of 20 psig at the suction side of the impeller. The impeller design of the present pump can run without detrimental cavitation at atmospheric pressure. The increased efficiency, the reduction in mechanical complexity of the present system, and the increased angle of attack on the suction entrances reduce the size of the pump so that it may be placed exterior to the hull. This outboard mounting of the pump of the present invention requires a minimum of hull modification and results in maximum utilization of the cockpit area. The efficiency of the present unit also reduces the size and the fuel comsumption of the required power plant.

The double volute exhaust system results in a single output jet which is employed to both propel and steer the boat. A system for reversing the thrust of the jet is also disclosed. These systems provide increased control over the boat through the efficient use of the jet. Further, the inlets to the pump are located behind the hull to better maintain suction. The inlets are positioned in back of rather than below the hull line to prevent excessive drag. The present pump configuration does not require ram jet pressure for efficient operation. Further, the pump operates substantially as a compressor when out of the water. Consequently, problems associated with priming and inducing a ram jet entrance pressure are not encountered. Thus, the drag associated with a ram scoop extending deep in the water are not encountered. However, sidewalls are provided which extend below the inlets. They aid in maintenance of the suction and do not provide significant amounts of drag.

Accordingly, an object of the present invention is to provide an efficient and compact outboard pump for driving a jet boat.

A second object of the present invention is to provide a pump having an inlet design which promotes rapid suction recovery, increases pump efficiency and reduces drag.

Further objects and advantages of the present invention will be made readily apparent from the following detailed description and accompanying drawings.

Figure 1:
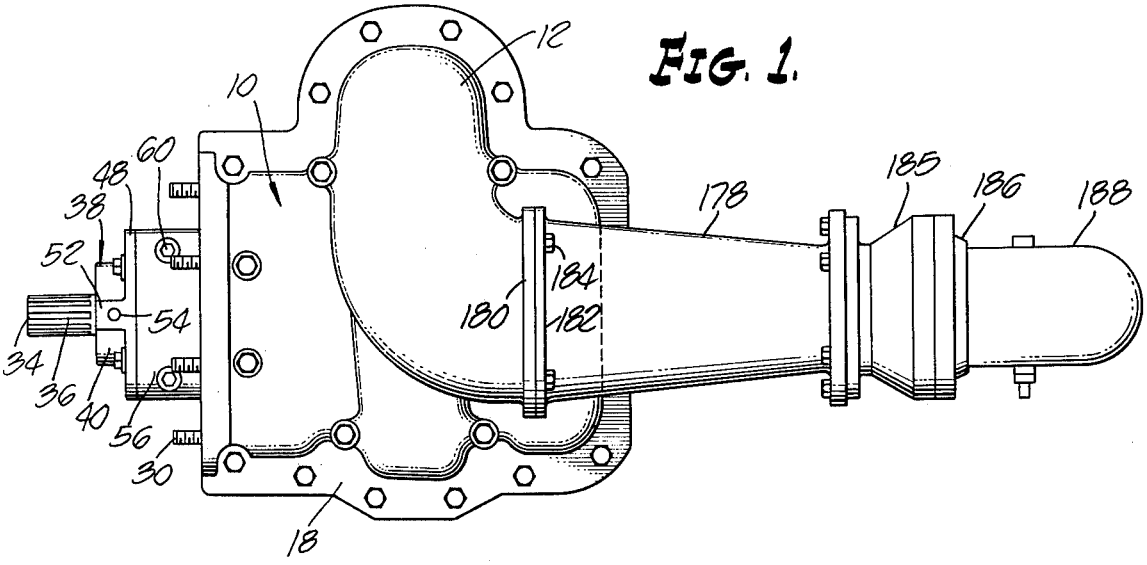
FIG. 1 is a top view of the present invention.
Figure 2:
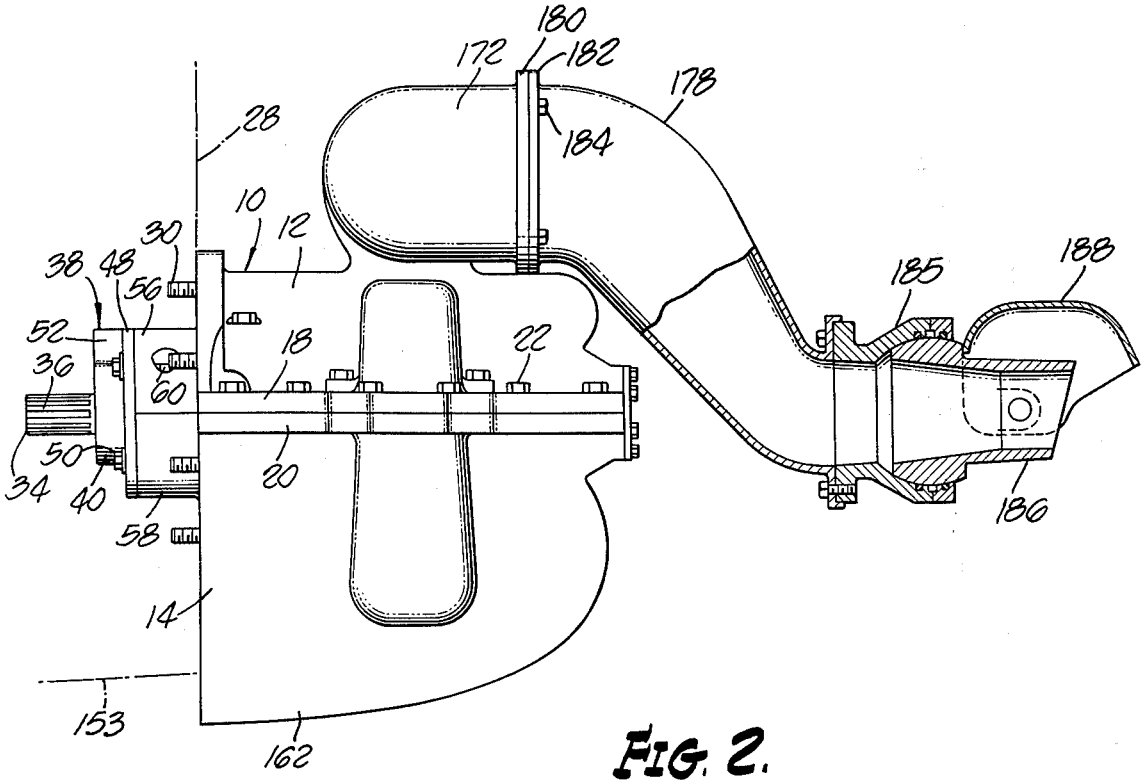
FIG. 2 is a side view of the present invention.
Figure 3:
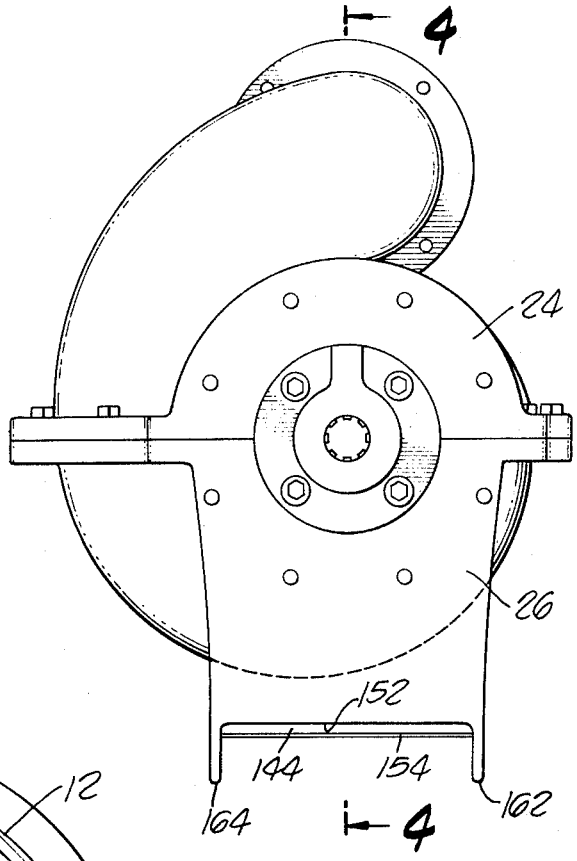
FIG. 3 is a front view of the present invention.
Figure 6:
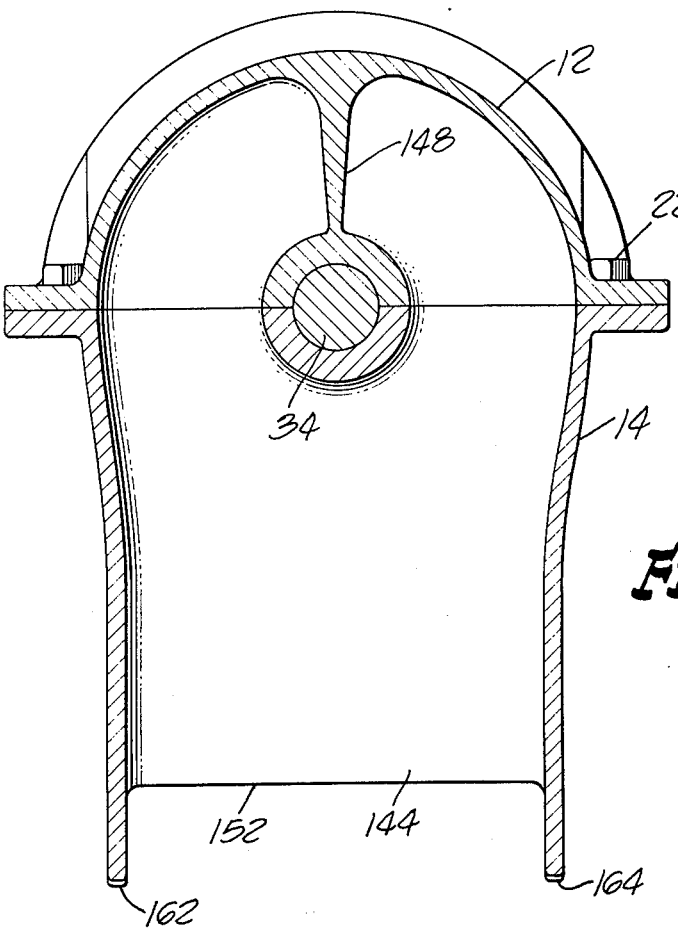
FIG. 6 is a cross-sectional elevation taken along line 6—6 of FIG. 4.
Figure 4:
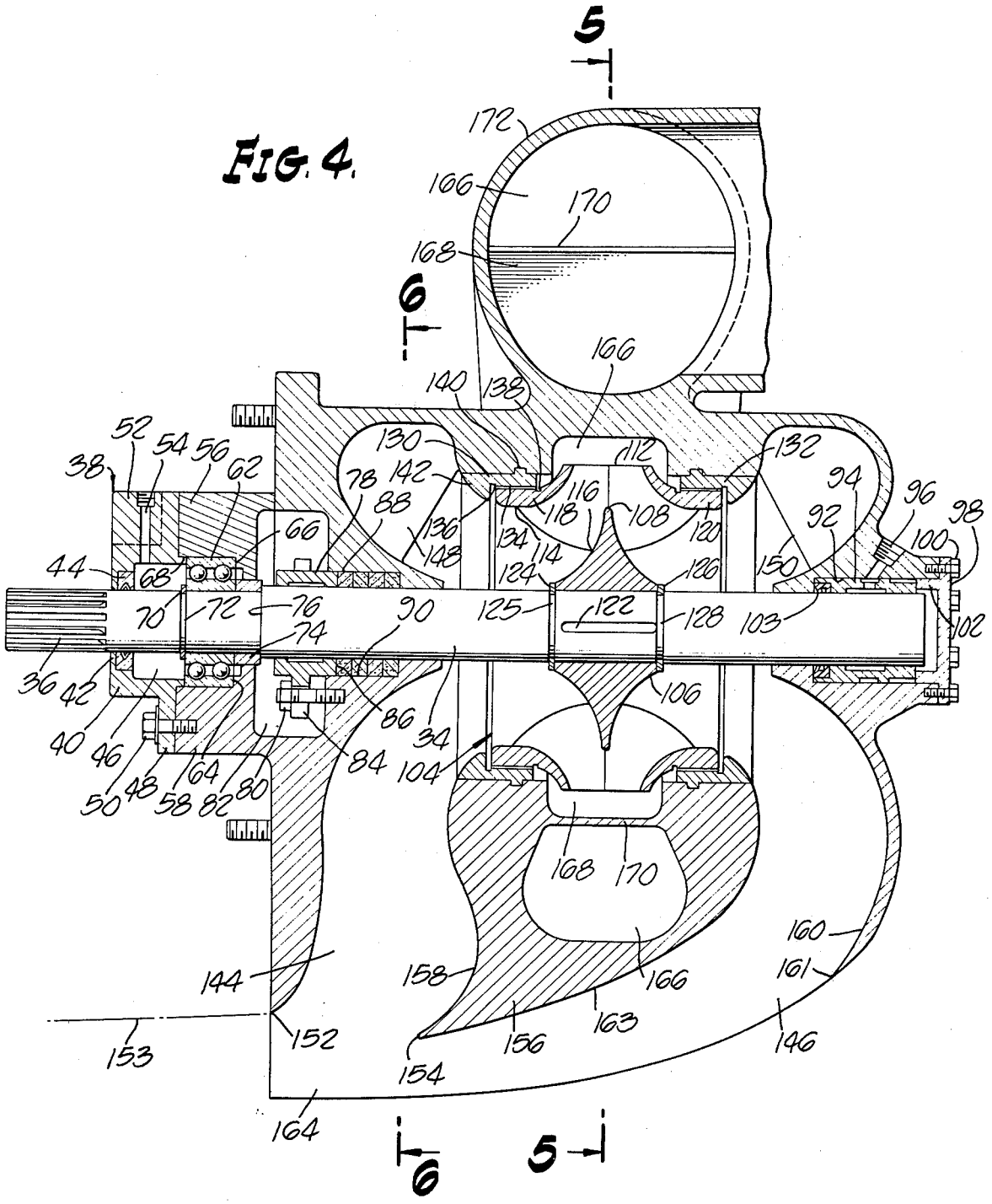
FIG. 4 is a cross-sectional side view taken along line 4—4 of FIG. 3.

The present invention employs and cooperates with the mechanisms disclosed in U.S. Pat. application to Onal, Ser. No. 382,374, filed July 25, 1973, and U.S. Pat. application to Onal et al, Ser. No. 447,749, filed Mar. 4, 1974, the disclosures of which are incorporated herein by reference. Turning specifically to the drawings, a horizontally split case generally designated 10 is disclosed. The case consists of an upper section 12 and a lower section 14. Flanges 18 and 20 are provided about the mating edges of the case sections 12 and 14 for placement of fasteners 22. A substantial number of fasteners are employed because of the pressure which is developed within the case 10 that would otherwise tend to force the case sections 12 and 14 apart. This would result in leaks and possible failure. Fasteners are also placed at other convenient locations to tie the sections together. The upper section 12 and the lower section 14 include flat mating surfaces 24 and 26, as best seen in FIG. 3 which are juxtaposed with the transom of the boat. A boat hull 28 is shown in phantom in FIG. 2. This placement illustrates the most advantageous position of the pump relative to the boat. However, where it is desired, the pump may be placed within the hull of the boat. Studs 30 extend from the surfaces 24 and 26 for easy attachment of the transom.

A shaft 34 extends through the housing 10 at the partline between sections 12 and 14. The shaft 34 is coupled at splines 36 to the engine of the boat. The coupling may be a direct drive to a turbine or more conventional power plant. The impeller and the drive shaft 34 is constrained to rotate along a fixed axis through the pump case 10 by means of bushings and bearings. A bearing cap 38 is positioned at the front of the pump about the shaft 34 and includes a generally circular housing 14 with a closed end 42 through which the shaft 34 extends. The bearing cap 38 includes a conventional seal 44 about the drive shaft 34 and set within the closed end 42. The seal 44 is inset into the front end of the bearing cap 38 to retain the placement of the seal. A cavity 46 is formed within the circular housing 40 of the cap 38. A flange 48 extends about the periphery of the housing 40. Fasteners 50 are employed to secure the bearing cap 38 to the pump. A boss 52 extends upward from the cylindrical housing 40 and has a lubrication port 54 located therethrough. The lubrication port 54 is in communication with the cavity 46 for lubrication of the bearings.

A simi-circular bearing cover 56 is positioned between the bearing cap 38 and the upper section 12 of the case 10. An extension 58 of the lower section 14 of the case 10 extends forward from the main body of the case 10 and mates with the semi-circular bearing cover 56. The semi-circular bearing cover 56 is fastened to the case extension 58 by fasteners 60 vertically placed through the cover 56 into the extension 58. The extension 58 and the cover 56 act in combination to fix the position of a bearing 62 which is employed to support and constrain the drive shaft 34. The bearing 62 is preferably of the thrust type and operates to prevent axial movement of the drive shaft 34 within the pump case 10. The bearing 62 is positioned relative to the case 10 by means of a shoulder 64 which extends inwardly from the bearing seal on the extension 58 and by a similar shoulder 66 positioned on the bearing cover 56. Axial motion of the bearing 62 forward relative to the pump case 10 is prevented by a lip 68 which extends in from the flange 48 to secure the bearing 62 against the shoulder 64 and 66.

The drive shaft 34 is axially positioned relative to the bearing by a snap ring 70 positioned within a groove 72 in the shaft 34. On the other side of the bearing 62 from the snap ring 70, a collar 74 is positioned about the drive shaft 34. The collar 74 extends between the bearing 62 and a position 76 on the shaft 34 where the shaft diameter increases. As a result, the collar 74 acts as a spacer between the bearing 62 and the discontinuity 76 in the shaft 34. The collar 74 may be allowed to rotate with the shaft 34 and the inner race of the bearing 62.

Located interior to the bearing assembly is a packing cover 78. The packing cover 78 is secured to both the upper and lower case sections 12 and 14 by fasteners 80. A cavity 82 is provided by the case 10 and the bearing cover 56. Where the space 82 is such that the packing cover 78 cannot be withdrawn from the fasteners 80, slots 84 may be used to engage the fasteners 80. The packing cover 78 extends around the shaft 34 and includes a flat surface 86 which retains packing material 88 in position in the case 10. The packing material 88 prevents the passage of moisture along the shaft 34 into the bearing assembly. A cylindrical cavity 90 is provided in the case 10 to receive the packing material 88.

A rear bushing assembly is provided to prevent lateral motion of the aft end of the drive shaft 34. A cylindrical cavity 92 is provided in the case 10 for receipt of a bushing 94. The bushing 94 may be an oil or grease lubricated bronze bushing. A lubrication port 96 is provided for communication with the lubricated bushing 94. An end cap 98 is bolted to the aft end of the casing 10 by fasteners 100. The cap 98 includes a circular lip 102 which extends inwardly to lock the bearing 94 in position. A seal 103 is provided to prevent seawater from entering the journal bearing area.

An impeller 104 is employed for providing energy to the incoming water to form the propulsive jet. The impeller 104 is of the double suction type and includes a central hub 106. The central hub 106 extends from the shaft 34 radially outward to a circular rim 108. Integrally formed with the central hub 106 are vanes 112. There are six vanes 112 on each side of the central hub 106 in the present embodiment.

The impeller 104 is designed for use with a 300hp to 650hp power plant. The operating speed of the pump will vary with the power plant employed. Using a 650 hp engine, the speed of the pump as herein disclosed is 6,500 rpm. Each vane 122 has a lead angle of 13° at the leading edge of the vane 112 adjacent the shroud at a position designated 114. The lead angle varies continuously across the leading edge of each vane 112 to a position adjacent the hub 106 designated 116 where the lead angle is 20°30′. At the discharge position of the vane, the lead angle is 23°. The discharge position of each vane 112 at the shroud lags behind the leading edge by 105°. The inside back corner of the vane lags the outside back corner at the shroud by 6°. The overall diameter of the impeller 104 is chosen to be 8 inches. The circular rim 108 of the central hub 106 has a diameter of 5¾ inches as does the position 114. Position 116 has a diameter of 3⅝ inches. The thickness of each vane varies from one-eighth to five-thirtyseconds inch. Shrouds 118 and 120 are positioned outside the vanes 112. The shrouds 118 and 120 have an inner diameter of 5¾ inches and extend outwardly to the periphery of the impeller at a diameter of 8 inches. The relative eye area between the vanes 112, the central hub 106 and the shrouds 118 and 120 is approximately 1.2 square inches. This gives a total relative eye area with 12 vanes of 14.4 inches. When driven at 4,400 RPM, the impeller is capable of pumping 3,400 GPM at an exit velocity of 23.97 feet per second.

To transfer power from the engine to the impeller 104, the impeller is fixed to rotate with the shaft 34. The shaft 34 and the impeller 104 may be constrained to rotate together by means of a key. Slot 122 is provided in the shaft 34. A slot (not shown) is also provided in the impeller hub 106. A key (not shown) is positioned in the slots. The impeller 104 is also held from moving axially forward on the shaft 34 by a snap ring 124 positioned in groove 125 of the shaft 34. To prevent axial movement backward on the shaft 34, a snap ring 126 is positioned in groove 128 immediately behind the impeller 104.

The impeller 104 and the case 10 are designed for hydraulic and dynamic balance. The impeller 104 is a double suction impeller and distributes water to a double volute system. Further, the high number of vanes provides a fairly continuous flow pattern with balanced reaction loads on the impeller 104. Consequently, the amount of vibration experienced by the pump is substantially reduced over unbalanced systems. The resulting bearing requirements are also reduced because the pump is hydraulically balanced; there are no significant hydraulic or dynamic forces acting against the thrust bearings. The double suction arrangement also is advantageous to the present system because of the larger eye area which is twice as large as the conventional single suction, mixed flow impellers of comparable size. Thus, a cavitation condition is avoided.

Two wear rings 130 and 132 are provided about the shrouds 118 and 120 of the impeller 104. These rings 130 and 132 minimize flow from the discharge side of the impeller to the suction side of the impeller. Each wear ring 130 and 132 includes an accurately machined wear surface 134 which is exterior to the impeller shrouds 118 and 120 which are also accurately machined. A groove 136 is cut into each wear ring 130 and 132 adjacent the wear surface 134. A similar groove 138 is provided on each of the shrouds 118 and 120. Both the outer surfaces of the shrouds and the machined surfaces 134 of the wear rings 130 and 132 may have oppositely oriented spiral grooves. These spiral grooves prevent the parts from freezing together during dry operation and help cut down flow of water around the impeller from the high pressure area of the impeller to the suction side to increase pump efficiency. The wear rings 130 and 132 also include an annular ridge 140 which extends into a corresponding groove in the casing 10. The ridge 140 prevents lateral movement of the waer rings 130 and 132. The annular ridge 140 extends continuously about the outer side of each of the wear rings 130 and 132 except for a small space on one point at the wear ring circumference where the annular ridge 140 is removed. At this point, the groove associated with the ridge 140 is also broken. This break in the groove prevents the ridge from sliding along the groove. As a result, the ridge 140 prevents both lateral and rotational movement of each of the rings 130 and 132. The wear rings 130 and 132 also each include a shoulder 142 which is spaced from the rotating impeller 104 but which forms a semi-continuous path from the case 10 to the inner side of each of the shrouds 130 and 132. This prevents major disturbances of the incoming flow.

As the impeller is of the double suction type, the casing 10 includes two inlet passages 144 and 146. These passages 144 and 146 extend upward around the shaft 34 to baffles 148 and 150, respectively. By extending the inlet passages 144 and 146 upward about the shaft 34, the inlet will provide influent to the total area of both sides of the impeller 104. The baffles 148 and 150 help prevent pre-rotation of the incoming water in front of the impeller vanes, thereby increasing the pump efficiency.

At the base of the inlet channels 144 and 146, two suction ports are provided which define inlets for said inlet channels. The suction ports are divided, as are the lower portions of the channels 144 and 146 by an extension 156 of the casing 10. The leading suction port to inlet channel 144 is defined by the lower leading edge 152 of the pump, the extension 156 and two side walls 162 and 164. The lower leading edge 152 extends only as far down as the lower edge of the transom, shown in phantom as 153. By so placing edge 152, resistence to the flow of water from under the hull is avoided. Further, the flow of water passing from under the hull is not disturbed and thereby caused to flow away from the leading suction port. The lower edge 154 of extension 156 extends below the leading edge 152 in order to physically force a portion of the flow into inlet channel 144 and sufficiently disturb the flow passing beneath the edge 154 to cause it to rise into the inlet channel 146. In the present embodiment, edge 154 of extension 156 extends below the leading edge 152 by nine-sixteenth of an inch. The water flowing under the hull will tend to rise when it reaches edge 152. The edge 154 catches this flow of water and forces it upwardly into the impeller. As the edge 154 is located behind the leading edge 152 by about 3.5 inches in the present embodiment, the elevation of edge 154 from edge 152 is around 9.25° below edge 152 as measured from a horizontal parallel with the centerline of the pump shaft. The leading side 158 of extension 156 follows a smooth curve in order that the flow of incoming water through inlet channel 144 will be disturbed as little as possible. The impeller also operates to create a reduction in pressure within inlet channel 144 which aids in the suction of water through the leading suction port.

The trailing suction port is defined by the extension 156, the lower edge 161 of the aft surface 160 of the inlet channel 146 and the two sidewalls 162 and 164. The leading edge 154 of the extension 156 tends to draw the water passing beneath the pump upwardly along the aft surface 163 of the extension 156 and into the inlet channel 146. This flow of water is then captured as it passes edge 161 of the aft surface 160 located around 13 to 14 inches behind leading edge 152. The edge 161 is set above the lower leading edge 152 because sufficient water will be drawn into channel 146 without further extending the aft surface 160. The location of edge 161 depends to some extent on the angle of attack assumed by the boat to which the pump is attached. When the boat is stationary, it will tend to sit lower in the water. Consequently, the determining condition as to the necessary placement of edge 161 is during motion of the boat when the hull is at least partially raised in the water. A range of locations depending on the angle of attack of the boat employed has been determined to be from 4.5° to 6° in elevation above the leading edge 152 as measured from a reference plane parallel to the centerline of shaft 34. The trailing surface 160 may extend below 4.5° elevation above the leading edge 152; however, sufficient water is provided by the present configuration with a minimum amount of drag. The location of edge 161 at 4.5° is necessary when the pump is employed with a boat having a center of gravity located relatively forward in the boat. In such a boat, motion through the water will not force the bow up to create a substantial angle of attach. In a boat having a center of gravity more toward the aft of the boat, the 6° placement of edge 161 may be employed. The proper location of edge 161 must be defined emperically for individual hull designs.

In both the front and rear channels 144 and 146, the flow of water thereto is aided by the impeller. The present embodiment provides sufficient suction pressure even when operating as a compressor to draw water upwardly from the two suction ports. Thus, the pump is self-priming and does not rely on a ram pressure to maintain prime. This self-priming characteristic allows the suction ports to be placed in a location which will allow them to periodically come out of the water in rough conditions without causing more than momentary loss of power. Further, the suction head requirements are such in the present embodiment that the pump does not require ram pressure for efficient operation. Substantial thrusts are developed with the boat stationary in the water. Consequently, maintenance of ram pressure using a high drag scoop is not necessary. The result of the present placement of the intake provides an optimum between maximum ram pressure and minimum drag.

It is preferred that the suction created by the action of the impeller 104 and the dynamic head created by the motion of the pump through the water can be maintained. When the suction ports are allowed to come out of the water, the dynamic head and the impeller suction is lost. This results in a loss of thrust from the pump. To overcome the loss of suction caused by the ports rising out of the water, sidewalls 162 and 164 extend along the sides of the suction ports. These sidewalls 162 and 164 prevent air from passing through the suction ports from the side. The sidewalls 162 and 164 do not extend across the front of the casing 10 or the back of the casing 10. Thus, water is allowed to move freely from front to back across the suction ports. The sidewalls 162 and 164 extend, in the present invention, two inches below the leading edge 152 and slowly curve upwardly to meet the trailing edge 161.

Figure 5:
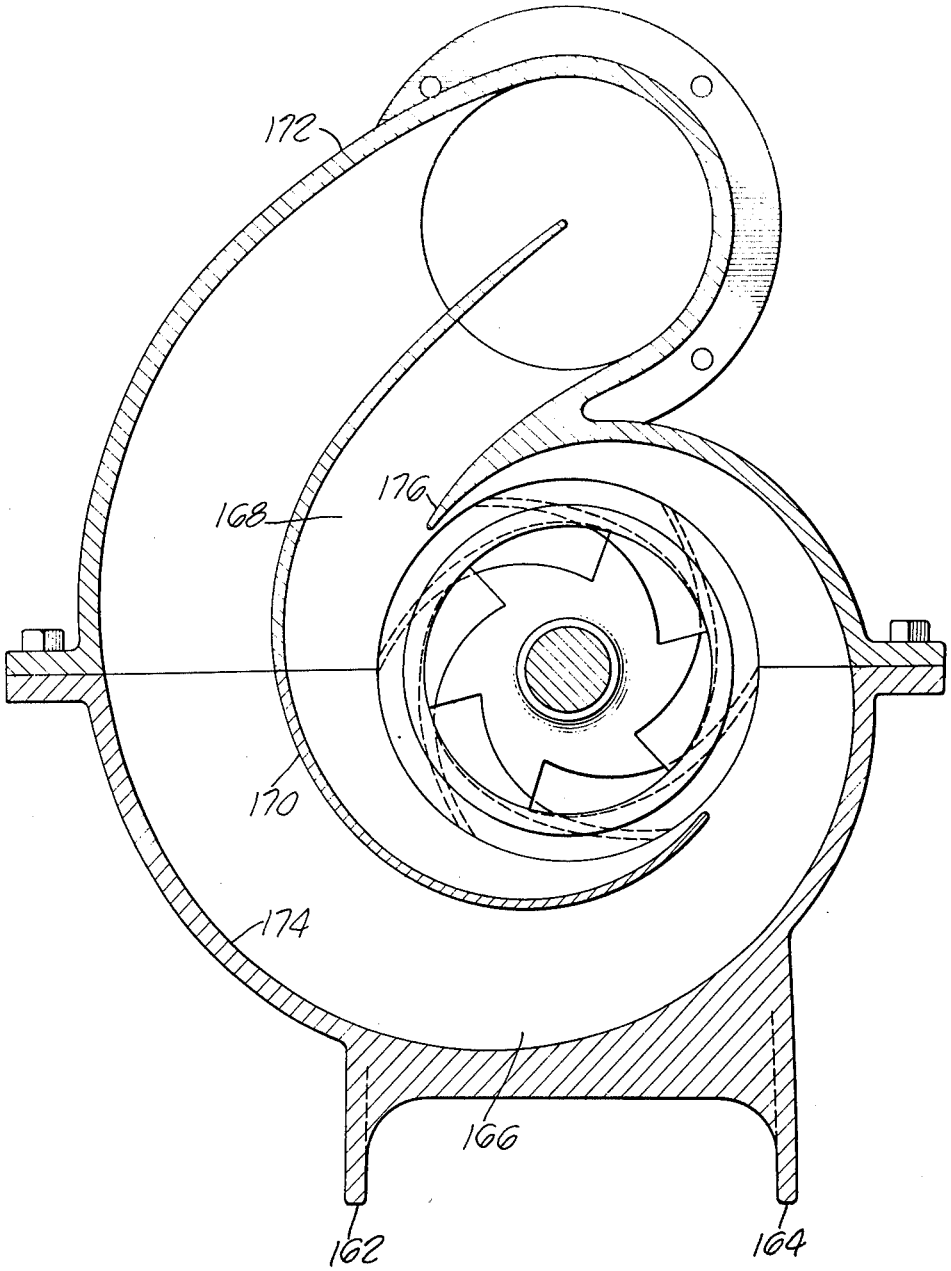
FIG. 5 is a cross-sectional elevation taken along line 5—5 of FIG. 4 with an unsectioned impeller in place.

Once the water is passed from the inlet passages 144 and 146 into the impeller 104, the water is forced radially outward into two volutes 166 and 168. The configuration of the two volutes is best seen in FIG. 5. Two volutes are employed to create opposite pressures which are nearly equal about the periphery of the impeller 104. This results in a substantial reduction in the unbalanced forces on the impeller which would otherwise be created by a single volute system. The two volutes 166 and 168 are separated by a wall 170 which is part of the casing 10. The wall 170 extends from the leading end of the volute 168 immediately adjacent the outer periphery of the impeller 104 to a single outlet conduit 172 to form the volute 168. The outer volute 166 is formed by the outer side of the wall 170 and the inner side 174 of the outer wall of the casing 10. The casing extends inwardly to a position immediately adjacent the outer periphery of the impeller 104 at 176.

The effluent received from the impeller 104 by the volutes 166 and 168 is passed through the outlet conduit 172 which forms the uppermost portion of the casing 10. The outlet conduit 172 receives water from the two volutes 166 and 168 which are disposed in a plane perpendicular to the centerline of the shaft 34 and directs the stream of water aft parallel to the centerline of the shaft 34.

In the present embodiment, a conduit 178 is coupled with the case 10 to extend the exhaust conduit 172 downward and then aft to exhaust rearwardly at a level near the level of the center of gravity of the boat. Flanges 180 to 182 are provided on the case 10 and the conduit 178 at the joint thereof. Conventional fasteners 184 may be employed to lock the conduit 178 to the case 10. The guidance bracket 185 receives the stream of water from the conduit 178 and directs it rearwardly to exhaust in a jet. Because of the double suction, double volute design, which is inherently more stable than the conventional mixed flow pumps, because of the wall 170 between the volutes extending to the exhaust end of the outlet conduit 172 to minimize vortex motion and because of the smooth curves and extended length of the conduit 178, the rooster tail effect is greatly reduced.

A ball and socket joint is formed between the guidance bracket 185 and a flow nozzle 186 to provide steering through an articulated nozzle. The ball and socket arrangement also allows certain motion of the flow nozzle about a horizontal axis under the high trust loads. Further, the ball and socket arrangement does not impede the flow of the output stream of water from the pump. A dual jet arrangement may also be used as disclosed in U.S. Pat. application to Onal et al, Ser. No. 447,749, filed Mar. 4, 1974, the disclosure of which is incorporated herein by reference.

The flow nozzle 186 terminates in a nozzle configuration which may be optimized for specific flow rates and pressures of the effluent using established nozzle theory. The nozzel 186 directs the jet aft at an angle which is most efficient considering the trim of the boat, the vector force directions of the exhausting jet and the wake characteristics created. A reversing nozzle 188 is also provided for backing the boat up.

Thus, a jet boat pump is disclosed which provides a low drag and efficient pump intake configuration for maximum pump performance. While embodiments and applications of this invention have been shown and described, it would be apparent to those skilled in the art that many more modifications are possible without departing from the inventive concepts herein described. The invention, therefore, is not to be restricted except by the spirit of the appended claims.

What is claimed is:

1. A pump for propelling a boat comprising a pump housing having two inlet channels for receiving water and outlet passage means for discharging water;

a pump shaft rotatably mounted in said pump housing; and a double suction impeller mounted concentrically on said pump shaft, said double suction impeller being in communication with said two inlet channels and said outlet passage means;

said two inlet channels extending from inlets below said housing to either side of said double suction impeller, the inlet to the first of said channels being defined by a first leading edge adapted to extend no lower than the bottom of the boat hull and a first trailing edge positioned behind and below said first leading edge, the inlet to the second of said channels being defined by said first trailing edge and a second trailing edge behind said first trailing edge and at a level higher than said first leading edge.

2. The pump of claim 1 wherein said second trailing edge is positioned at an elevation about between 4.5° and 6° above said first leading edge.

3. The pump of claim 1 further comprising side walls extending below said inlets.

4. The pump of claim 3 wherein said sidewalls extend about 2 inches below said first leading edge and curve upwardly to meet with said second trailing edge.

5. The pump of claim 1 wherein said first trailing edge is positioned at an elevation of about 9¼° below and behind said first leading edge.

6. A pump for propelling a boat comprising a pump housing having two inlet channels for receiving water and outlet passage means for discharging water;

a pump shaft rotatably mounted in said pump housing; and a double suction impeller mounted concentrically on said pump shaft, said double suction impeller being in communication with said two inlet channels and said outlet passage means;

said two inlet channels extending from inlets below said housing to either side of said double suction impeller, the inlet to the first of said channels being defined by a first leading edge adapted to extend no lower than the bottom of the boat hull and a first trailing edge positioned at an elevation of about 9¼° below and behind said first leading edge, the inlet to the second of said channels being defined by said first trailing edge and a second trailing edge behind said first trailing edge and positioned at an elevation about between 4.5° and 6° above said first leading edge, the inlets further being defined by sidewalls extending below said inlets on either side thereof.

* * * * *